United States Patent [19]

Damsohn et al.

[11] Patent Number: 4,881,595

[45] Date of Patent: Nov. 21, 1989

[54] CLAMPING CONNECTION

[75] Inventors: Herbert Damsohn, Aichwald; Juergen Hoeing, Esslingen; Lieselotte Heck, Gerlingen, all of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 251,247

[22] Filed: Sep. 30, 1988

[30] Foreign Application Priority Data

Sep. 30, 1987 [DE] Fed. Rep. of Germany ..... 3732964

[51] Int. Cl.[4] ..... F28F 9/02

[52] U.S. Cl. ..... 165/173; 403/274

[58] Field of Search ..... 165/173; 403/274, 284

[56] References Cited

U.S. PATENT DOCUMENTS

| | | | |
|---|---|---|---|
| 4,331,201 | 5/1982 | Hesse | 165/153 |
| 4,378,174 | 3/1983 | Hesse | 165/173 X |
| 4,649,628 | 3/1987 | Allemandou | 165/148 |

FOREIGN PATENT DOCUMENTS

| | | | |
|---|---|---|---|
| 145574 | 6/1985 | European Pat. Off. . | |
| 2816291 | 10/1979 | Fed. Rep. of Germany | 165/173 |
| 3412632 | 11/1984 | Fed. Rep. of Germany . | |
| 2138335 | 10/1984 | United Kingdom . | |

*Primary Examiner*—Robert G. Nilson

*Attorney, Agent, or Firm*—Foley & Lardner, Schwartz, Jeffery, Schwaab, Mack, Blumenthal & Evans

[57] ABSTRACT

In a clamping connection between a plastic water tank equipped with at least one flange and a heat-exchanger tube sheet carrying a deformable edge region, an elastic sealing device being retained therebetween under prestress, and the deformable edge region, before its deformation, extends parallel to the outer contour of the flange and, after its deformation to make the clamping connection, it has first partial regions deformed in an approximately wave-shaped manner over the flange of the plastic water tank, and non-deformed further partial regions extending parallel to the outer contour of the flange. The first partial regions deformed over the flange of the plastic water tank make a positive connection, in which the lower edges of the deformed first partial regions rest on the top side of the flange under prestress. To make deformation easier, the deformable first partial regions are cut free parallel to and at a distance from an outer edge at the height of the flange top edge. In order to guarantee a leak-proof connection even with wide production tolerances it is proposed to form on the top side of the flange of the plastic water tank, at least partially, a sloping face in the region of the deformed first partial regions, the sloping face descending toward the outer contour of the flange, and the lower edges of the respective deformed first partial regions being deformed over this sloping face.

5 Claims, 2 Drawing Sheets

CLAMPING CONNECTION

BACKGROUND OF THE INVENTION

The present invention relates to a clamping connection between a plastic water tank equipped with at least one flange and a heat-exchanger tube header plate or sheet carrying a deformable edge region, and having an elastic sealing means retained therebetween under prestress. Before deformation, the deformable edge region extends parallel to the outer contour of the flange. After deformation to make the clamping connection over the flange of the plastic water tank, the edge region has first partial regions deformed in an approximately wave-shaped manner and non-deformed further partial regions extending parallel to the outer contour of the flange. The first partial regions deformed over the flange of the plastic water tank make the positive connection, in which the lower edges of the respective deformed first partial regions rest on the top side of the flange under prestress, and in which, to make deformation easier, the deformed first partial regions are cut free parallel to and at a distance from an outer edge at the height of the flange top edge.

Such a clamping connection is known from German Offenlegungsschrift 2,852,508. In order to guarantee that the clamping connection is maintained leak-proof even at relatively high pressures in the heat exchanger, the flange of the plastic water tank, in particular, has to be produced with narrow tolerances. Nevertheless, leaks can occur as a result of slight unevenness and distortion of the plastic.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

To avoid the limitations described, an object on which the present invention is based is to improve the known clamping connection in such a way that a leak-proof clamping connection is provided.

Another object of the present invention is to provide a leak-proof clamping connection even in the case of relatively wide production tolerances.

These and other objects are accomplished in one aspect of the invention by providing a clamping connection comprising a plastic water tank equipped with at least one flange and a heat-exchanger tube sheet carrying a deformable edge region; and an elastic sealing means being retained under prestress between the tank and the sheet, the deformable edge region, before its deformation, extending parallel to the outer contour of the flange and, after its deformation to make the clamping connection, having, over the flange of the plastic water tank, first partial regions deformed in an approximately wave-shaped manner and non-deformed further partial regions extending parallel to the outer contour of the flange, wherein the deformable first partial regions are cut free parallel to and at a distance from an outer edge of the sheet at the height of the flange top edge, and the lower edges of the deformed first partial regions rest on the top side of the flange under prestress, wherein the top side of the flange of the plastic water tank has, at least partially, a sloping face in the region of the deformed first partial regions, wherein the sloping face descends towards the outer contour of the flange, and wherein the lower edges of the respective deformed first partial regions are deformed over this sloping face.

Further objects, features and advantages of the invention will become apparent from the following detailed description of preferred embodiments, when considered in conjunction with the accompanying drawing figures. It is to be expressly understood, however, that the drawing figures are not intended as a definition of the invention but are for the purpose of illustration only.

BRIEF DESCRIPTION OF THE DRAWINGS

The invention is explained in detail below by means of the accompanying drawings of a preferred exemplary embodiment.

DETAILED DESCRIPTION OF THE PREFERRED EMBODIMENTS

The top side of the flange or of the flanges of the plastic water tank has, at least partially, a sloping face in the region of the deformed first partial regions. The sloping face descends toward the outer contour of the flange, and the lower edges of the respective deformed first partial regions are deformed over this sloping face. When the clamping connection is closed as a result of the deformation of the first partial regions, there is also a certain increase in the prestress of the elastic sealing means which, in the course of assembly, is already prestressed during the closing operation. Because, during the deformation of the first partial regions, part of the sloping face of the flange of the plastic water tank is in each case shaved off locally by the lower edge of the deformed first partial region, even relatively wide production tolerances can be compensated directly, so that even relatively large dimensional deviations cannot cause any leakage of the clamping connection.

A saving of material, while at the same time ensuring that the wall thicknesses are kept as constant as possible even in the region of the flange, can be obtained if the flange of the plastic water tank has molded closing projections, and if these closing projections carry the sloping faces. Because the wall thicknesses of the plastic water tank are essentially the same everywhere, the cooling time during production can be kept short at the same time, and more uniform filling is also achieved during the injection-molding operation, associated with less internal stresses, with the result that dimensional accuracy is also improved because of less distortion.

Furthermore, between the closing projections there can be higher rib protrusions which extend beyond the sloping faces and the outer contours of which are aligned with the outer contour of the flange. This alignment of the outer contours prevents the non-deformed partial regions of the deformable edge region of the tube sheet which are supported by them from being deformed inwardly, so that, at the same time a simplification in the assembly tools and an increase in reliability of assembly, are achieved.

Preferably, the angle of inclination of the sloping faces of the flange is approximately 10° in relation to the sealing face.

Figure 2:
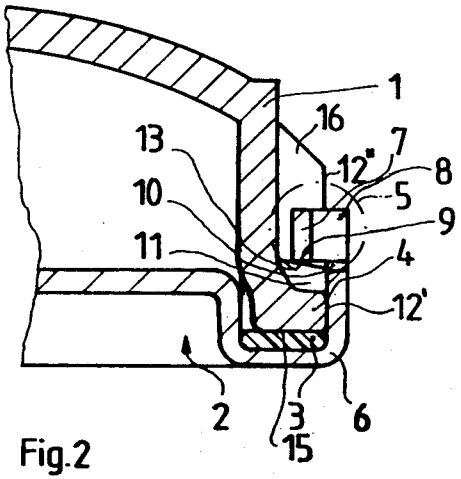
FIG. 2 shows the clamping connection in a section along the line II—II of FIG. 3, on a larger scale.
Figure 1:
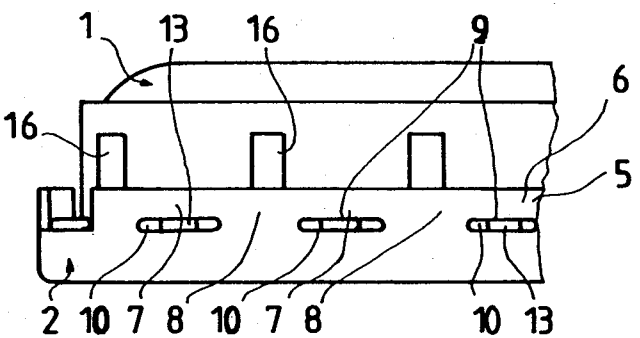
FIG. 1 shows a front view of the clamping connection.
Figure 3:
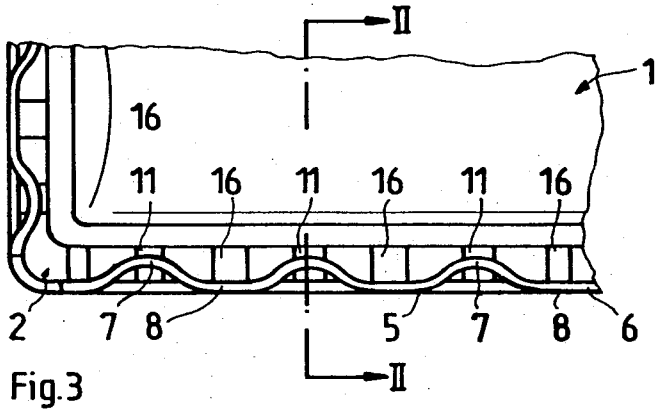
FIG. 3 shows a top view of the clamping connection.
Figure 4:
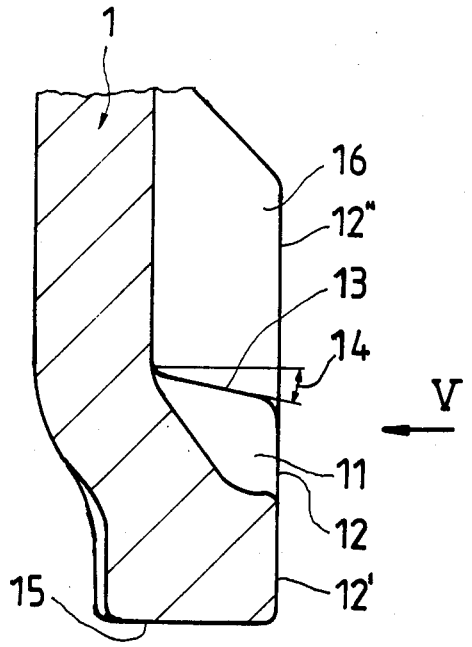
FIG. 4 shows a cross-section along the line IV—IV of FIG. 5, of the flange of the plastic water tank on a larger scale.
Figure 5:
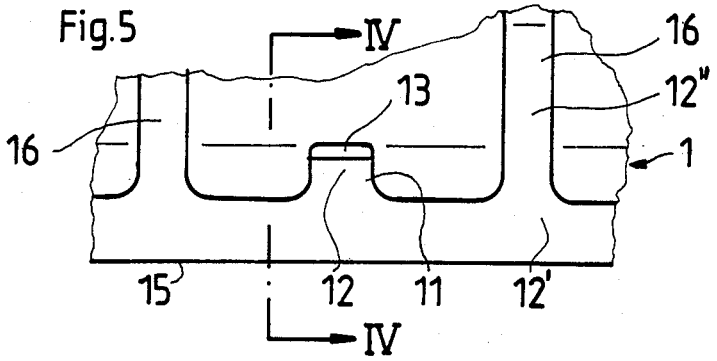
FIG. 5 shows a side view of a partial region of the flange in the direction of the arrow V in FIG. 4.

FIGS. 1 to 3 show the clamping connection in the finished, that is to say, closed state. The components in question are a plastic water tank 1 and a metal tube sheet 2 which are connected to one another in a liquid-tight and pressure-tight manner, with an elastic sealing means 3 interposed. The two parts form the collecting vessel of a heat exchanger, for example, a radiator for motor vehicles, which is not shown completely.

The sealing means 3 is received in a U-shaped outer edge 6 of the tube sheet 2, together with a flange 4 of the plastic water tank 1. The outer and upper part of the outer edge 6 consists alternately of deformed first partial regions 7 and of non-deformed further regions 8. When the clamping connection is in the closed state, therefore, the deformable region 5 of the outer edge 6 has a wave shape, as is evident from FIG. 3. For this purpose, the deformed first partial region 7 of the tube sheet 2 must be cut free. In the exemplary embodiment, this is obtained by means of long holes 10, of which the lower edges 9 bent over the flange 4 are an essential component of the clamping connection.

To ensure that the wall thickness of the plastic water tank 1 is, as far as possible, the same everywhere, the flange 4 is equipped with protruding, molded closing projections 11, the outer contours 12 of which extend in line with the outer contour 12, of the flange and which carry a sloping face 13 on their top side. The angle of inclination 14 of these sloping faces is, in a preferred embodiment, approximately 10° in relation to the sealing face 15 of the tube sheet 2.

Between the individual closing projections 11, there are rib protrusions 16 which extend higher and the outer contours 12'' of which are aligned with the outer contour 12' of the flange, so that, when the first partial regions 7 of the deformable edge region 5 are bent in, the non-deformed further partial regions 8 are supported to thereby prevent undesirable deformation.

German Offenlegungsschrift 2,852,408 describes in detail how the clamping connection is made and also how it is subsequently disassembled when appropriate. In the present invention, after the sealing means 3 has been inserted into the tube sheet 2, the water tank 1 is pressed against the sealing means 3 and the water tank and tube sheet are prestressed to a nominal dimension. This nominal dimension is reaohed when the top edge of the water-tank flange 4 is underneath the top edges of the long holes 10. The connection is then closed by a bending-in of the first partial regions 7. During this bending-in of the first parts 7, finally there is, as a result of their lower edges 9, after sliding on the sloping face 13, a certain shaving off of the plastic when elastic compliance is no longer possible. Dimensional deviations in terms of the height of the closing projections 11 in relation to the sealing face 15, provided that these are sufficiently high, therefore have no influence on the leak-proofing of the clamping connection. Consequently, plastic water tanks 1 with relatively wide production tolerances, particularly even at the flanges 4 with their closing projections 11, can be used without disadvantage, so that substantially fewer rejects have to be separated out. Nevertheless, the leak-proofing of the heat exchangers is guaranteed even at a relatively high internal pressure.

What is claimed is:

1. A clamping connection comprising:

a plastic water tank equipped with at least one flange;

a heat-exchanger tube sheet carrying a deformable edge region; and an elastic sealing means retained under prestress between said tank and said sheet, the deformable edge region, before its deformation, extending parallel to the outer contour of the flange and, after its deformation to make the clamping connection, having first partial regions deformed in an approximately wave-shaped manner over the flange of the plastic water tank, and non-deformed further partial regions extending parallel to the outer contour of the flange, wherein the first partial regions are cut free parallel to and at a distance from an outer edge at the height of the flange top edge and the lower edges of the deformed first partial regions rest on the top side of the flange under prestress, and wherein the top side of the flange of the plastic water tank has, at least partially, a sloping face in the region of the deformed first partial regions, wherein the sloping face descends toward the outer contour of the flange, and wherein the lower edges of the respective deformed first partial regions are deformed over this sloping face.

2. A clamping connection as claimed in claim 1, wherein during the deformation of the first partial regions of the deformable edge region, part of the sloping faces of the flange of the plastic water tank is in each case shaved off locally by the lower edge of the deformed first partial region.

3. A clamping connection as claimed in claim 1, wherein the flange of the plastic water tank has protruding, molded closing projections, and wherein the sloping face is provided, respectively, on each of the closing projections.

4. A clamping connection as claimed in claim 3, wherein between the closing projections there are higher rib protrusions which extend beyond the sloping faces and the outer contours of which are aligned with the outer contour of the flange.

5. A clamping connection as claimed in claim 1, wherein the angle of inclination of the sloping faces is approximately 10° in relation to the sealing face of the flange.

* * * * *